United States Patent [19]

Langen et al.

[11] Patent Number: 4,835,947

[45] Date of Patent: Jun. 6, 1989

[54] LOAD ACCUMULATOR FOR CARTON LOADING MACHINE

[75] Inventors: Marinus J. M. Langen, Toronto; Peter Guttinger, Milton, both of Canada

[73] Assignee: H. J. Langen & Sons Limited, Mississauga, Canada

[21] Appl. No.: 133,609

[22] Filed: Dec. 16, 1987

[51] Int. Cl.[4] ..... B65B 35/30

[52] U.S. Cl. ..... 53/542; 271/187; 271/195; 271/309; 271/315; 414/791.6; 414/798.6; 198/431

[58] Field of Search ..... 53/542; 271/187, 195, 271/309, 315; 414/46, 47, 107

[56] References Cited

U.S. PATENT DOCUMENTS

| | | | |
|---|---|---|---|
| 2,421,874 | 6/1947 | Fouse | 414/107 X |
| 3,162,438 | 12/1964 | Perry | 271/187 |
| 3,810,344 | 5/1974 | Evans et al. | 414/46 X |
| 3,851,773 | 12/1974 | Kluge et al. | 271/315 X |
| 4,102,253 | 7/1978 | Gannicott | 271/315 X |
| 4,120,491 | 10/1978 | Lang | 271/178 X |
| 4,275,874 | 6/1981 | DiBlasio | 271/187 X |
| 4,405,126 | 9/1983 | Frye et al. | 271/195 X |
| 4,511,136 | 4/1985 | Yamada et al. | 271/315 X |

*Primary Examiner*—Robert L. Spruill
*Assistant Examiner*—Beth Bianca
*Attorney, Agent, or Firm*—Fetherstonhaugh & Co.

[57] ABSTRACT

A load accumulator for accumulating a load which consists of a plurality of items and transferring the accumulated load into a receptacle of a carton loading machine. The accumulator has a load accumulator spool which has a plurality of pockets formed therein at circumferentially spaced intervals about its perimeter. A transfer channel extends circumferentially of the spool from its perimeter to a radial depth which is greater than that of the inner end of each pocket. A load accumulating platform is provided which has a load arresting extension which extends into the transfer channel and serves to arrest the movement of the load articles which are carried by the spool such that the load items are discharged onto the platform in a side-by-side relationship. A backstop is slidably mounted on the platform for movement toward and away from the spool. A front stop is arranged opposite the backstop and is mounted for movement between a retracted position in which it is located within the transfer channel inwardly of the inner end of the pockets and an advanced position in which it overlies the platform and is located outwardly from the perimeter of the spool to cooperate with the backstop to form lateral guideways for guiding the lateral transfer of the accumulated load from the platform into a receptacle. A pusher is located at one side of the platform for pushing the accumulated load along the lateral guideways into a receptacle located at the other side of the platform.

1 Claim, 5 Drawing Sheets

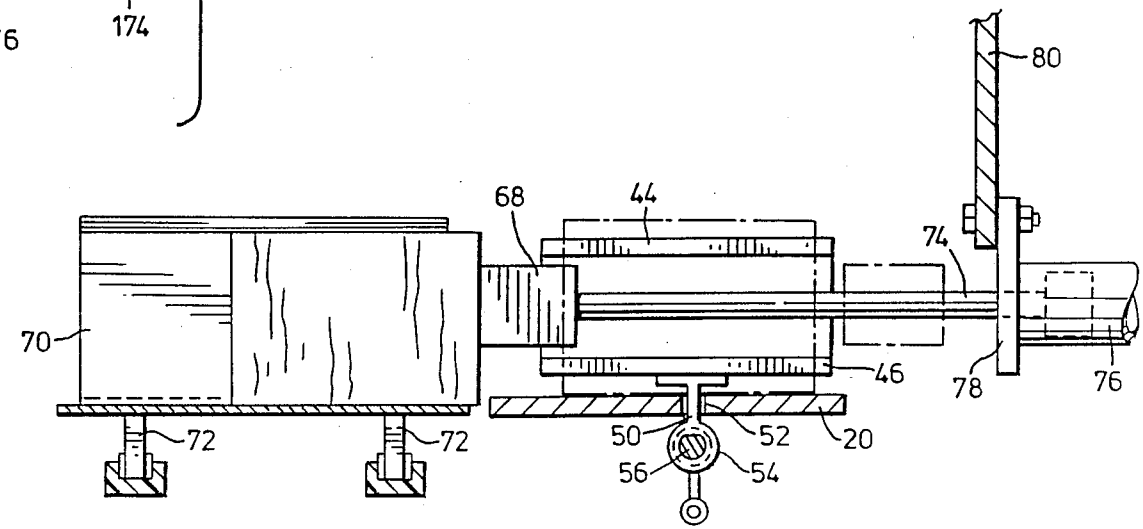
FIG.4
FIG.5
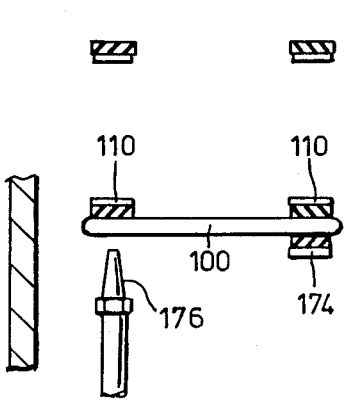

LOAD ACCUMULATOR FOR CARTON LOADING MACHINE

FIELD OF INVENTION

This invention relates to load accumulators for carton loading machines.

Considerable difficulty has been experienced in attempting to provide load accumulating mechanisms for use in carton loading machines when the load items which are to be accumulated must be stacked in groups of a predetermined number of load items prior to loading into a carton. When each assembled load consists of a plurality of load items difficulty has been experienced in accumulating a stack of these items and isolating them from further and subsequent stacks prior to loading into a carton loading machine. In addition, carton loading machines are capable of operating at high speed and consequently any load accumulating device which is to be used to accumulate a load must also be capable of operating at high speed.

In machinery designed to operate at high speed it is important to avoid a situation where reciprocating movement is used extensively in the load accumulating mechanism because of the extensive wear which is experienced by this type of mechanism.

Rotary load accumulators have been used for the purposes of accumulating load items such as envelopes on a discharge platform. These rotary load accumulators have included a rotar formed with slots for receiving envelopes and a discharge platform which includes a tongue which extends into a channel formed in the rotar in order to remove the envelopes from the slots and accumulate them on a platform. These devices have not, however, been used as load accumulating devices in carton loading machines of the like.

Difficulty has long been experienced in attempting to provide a switching mechanism which will serve to selectively direct load items along one or other of two or more guide paths in which they must driven through a carton loading machine or the like. Switching mechanisms which involve the mechanical movement of high speed conveyors are costly to manufacture and maintain.

In the carton loading machine which we have developed load accumulating spools are used to accumulated a predetermined number of load items on a loading platform and front and back stops are provided in association with the platform to provide guides for guiding the accumulated load as it is discharged laterally from the platform.

In addition, we provide a conveyor system which includes a switching system for selectively directing a plurality of load items to each load accumulating station as required.

SUMMARY OF INVENTION

According to one aspect of the present invention, there is provided in a carton loading machine a load accumulator for accumulating a load which consists of a plurality of items and transferring the accumulated load into a receptacle comprising: a load accumulator spool mounted for rotation about a first axis, said spool having a plurality of pockets formed therein at circumferentially spaced intervals about its perimeter, said pockets each having an entrance opening at the perimeter of the spool and extending inwardly from the entrance along a generally spiral path and having an inner end which is radially spaced from said first axis, a transfer channel extending circumferentially of the spool from its perimeter to a radial depth which is greater than that of the inner end of each pocket, load delivery means for delivering load items one at a time to said spool to load each pocket as the spool is rotatably driven, a load accumulating platform having a front end and a back end, said platform having a load arresting extension which is located circumferentially downstream of said load delivery means with respect to the perimeter of the spool, said load arresting extension extending into said transfer channel to a depth which is greater than that of the inner ends of the pockets whereby the movement of the load articles carried by the spool is arrested by the load arresting extension and the load items are discharged onto said platform in a side-by-side relationship, backstop means slidably mounted on said platform for movement toward and away from said spool, said backstop means being normally urged toward said spool and serving to maintain the load items in a side-by-side relationship when they are removed from the spool by the load arresting extension, front stop means arranged opposite the backstop means and mounted for movement between a retracted position in which it is located within said transfer channel inwardly of said inner end of said pockets and an advanced position in which it overlies said platform and is located outwardly from the perimeter of said spool to cooperate with the backstop to form lateral guideways for guiding the lateral transfer of the accumulated load from the platform into a receptacle, pusher means at one side of said platform for pushing the accumulated load along the lateral guideways into a receptacle located at the other side of the platform.

According to a further aspect of the present invention there is provided in a carton loading machine the improvement of: at least two load accumulating stations, a first load switching station in which load items are selectively directed to a first of said load accumulating stations or a second of said load accumulating stations, primary conveyor means forming a primary load transporting path which leads to and beyond said first load switching station and secondary conveyor means forming a branch path which extends from said first load switching station to said first load accumulating station, said first load switching station having an input passage which communicates with the primary conveyor to receive load items which are driven into the switching station along said primary path, and first and second output passages communicating with the primary and secondary conveyor respectively to receive load items for transportation along said first or second paths, switching means in said switching station for selectively directing load items which are admitted to the station, through the input passage, to the first or second input passage as required, to accumulate the required number of load items at each load accumulator in turn.

The invention will be more clearly understood after reference to the following detailed specification read in conjunction with the drawings wherein:

FIG. 4 is a sectional end view of the load transfer mechanism showing the transfer of the accumulated load from the load accumulating platform into a receptial;

FIG. 5 is a sectional view of the primary load transfer conveyor system taken along the line 5—5 of FIG. 2;

Figure 1:
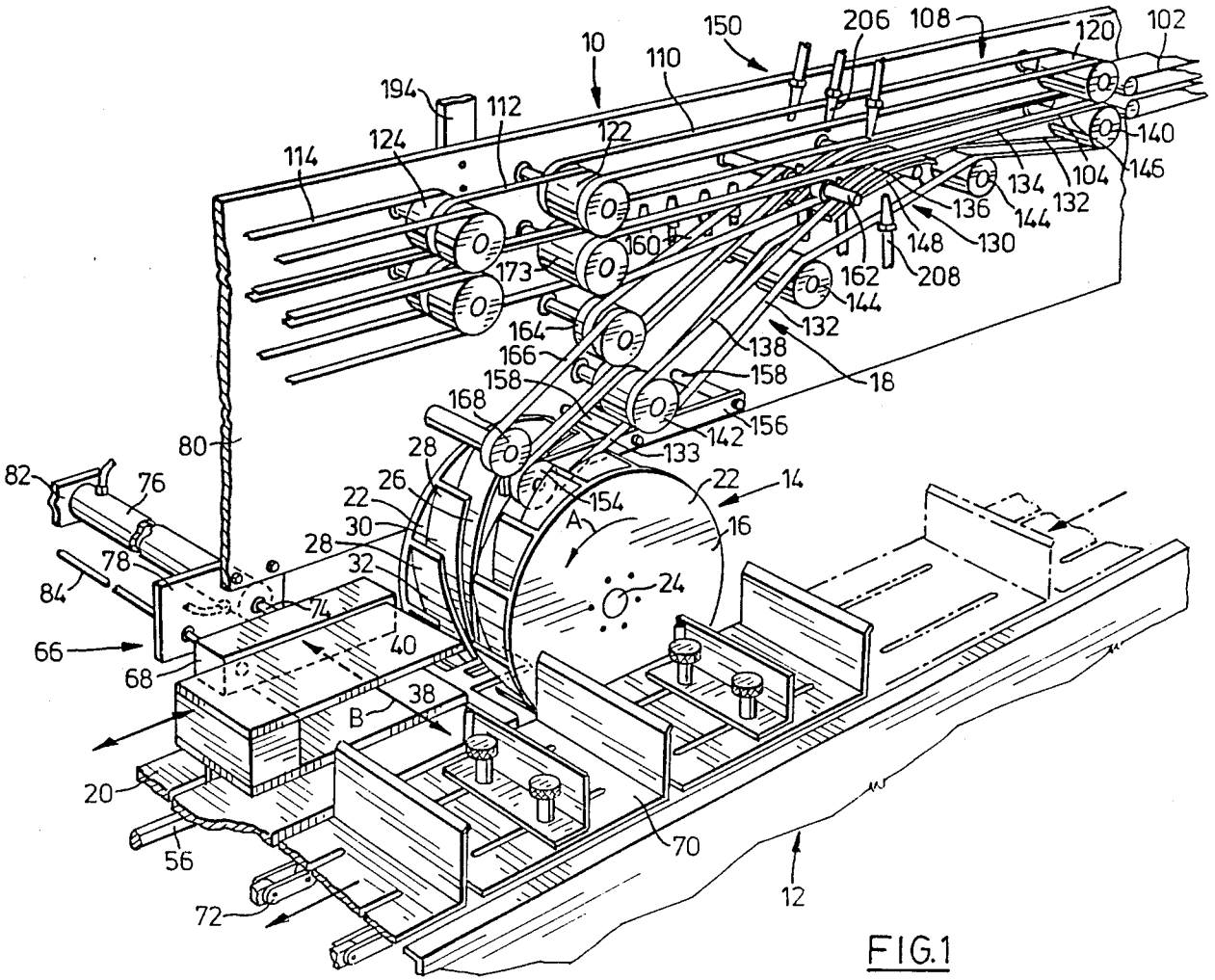
FIG. 1 is a perspective view of a load accumulating station of a carton loading machine constructed in accordance with an embodiment of the present invention.
Figure 2:
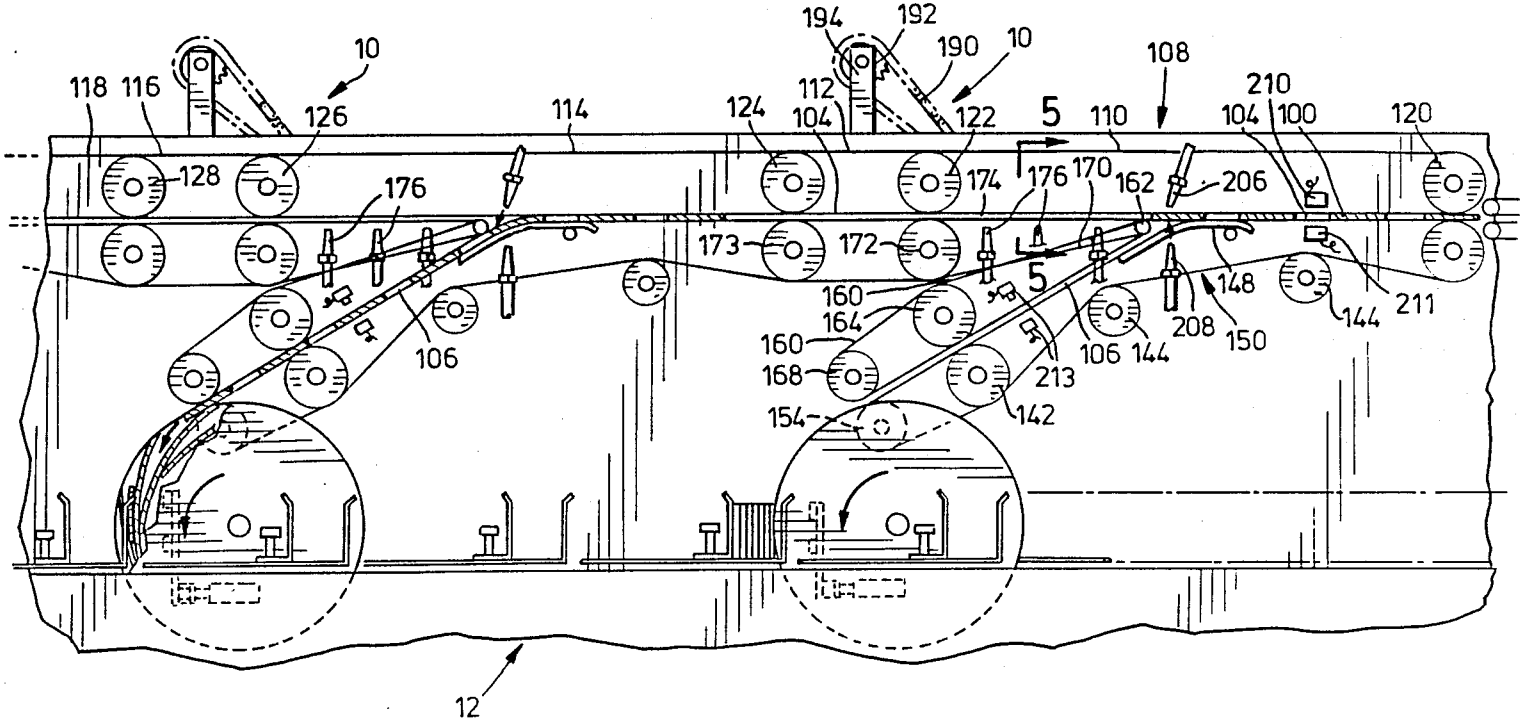
FIG. 2 is a side view of the carton loading machine in FIG. 1 showing two load accumulating stations.

With reference to FIG. 1 of the drawings, the reference numeral 10 refers generally to a load accumulating station of a carton loading machine which is generally identified by the reference numeral 12. As illustrated in FIG. 2 of the drawings more than one load accumulating station 10 is provided.

A load accumulator generally identified by the reference numeral 14 is provided in each load accumulating station 10. The load accumulator 14 has a load accumulating spool 16, a load delivery conveyor system 18 and a load accumulating platform 20.

The load accumulating spool 16 is in the form of a wheel which has two circular wheel sections 22 mounted on a shaft 24 in a spaced relationship to provide a transfer channel 26 therebetween. The wheel sections 22 each have a plurality of blades 28 formed thereon which cooperate with one another to form article receiving pockets 30 therebetween. The pockets 30 have an entrance 32 opening at the perimeter of the spool. As shown more clearly in FIG. 3 of the drawings, the blades 28 extend inwardly from the entrance 32 along a generally spiral path and converge toward their inner ends to define the opposite side walls of the pockets 30. In use, the load accumulating spool 16 is rotatably driven in the direction of the arrow A.

The load accumulating platform 20 has a front end 34 and a back end 36. A load arresting extension 38 is formed at the front end 34 of the platform 20 and is arranged to extend into the transfer channel 26. The load arresting extension 38 is shaped in the form of a fork and has a central slot 40 formed therein which serves to provide clearance for the front stop as will be described hereinafter. A back stop 42 is slideably mounted on the platform 20. The backstop 42 comprises upper and lower plates 44 and 46 which are spaced from one another by a spacer block 48. Legs 50 and 51 extend downwardly from the lower plate 46 through a slot 52 found in the platform 20 as shown in FIG. 4 of the drawings. The legs 50 and 51 are each formed with a tubular sleeve member 54 at their lower end which is slideably mounted on a support shaft 56 which is supported by a wall 58 of the frame of the machine. A tension spring 60 has one end connected to the arm 62 which extends downwardly from the leg 50 and its other end connected to the wall 58 and serves to normally urge the back stop 42 toward the load accumulating spool 16.

A channel 64 is provided between the upper plate 44 and the lower plate 46 to permit a pusher element to pass therethrough as will now be described.

A pusher mechanism 66 is provided for laterally discharging the accumulated load from the load accumulating platform 20 into receptacle 70 which are mounted on a conveyor 72 which will be described hereinafter. The pusher mechanism 66 has a pusher blade 68 which is proportioned to fit within the channel 64. The pusher plate 68 is mounted on a shaft 74 of a double acting pneumatic cylinder 76. The cylinder 76 is mounted on a support plate 78 which is, in turn, mounted on the frame plate 80. The outer end of the cylinder 76 is also mounted on a frame member 82. A guide rod 84 is mounted on the pusher blade 68 and extends through a guide passage formed in the support plate 78 and serves to prevent rotation of the pusher plate 68 about the shaft 74. The pusher plate 68 can be reciprocally driven by operating the double acting pneumatic cylinder in the direction of the arrows B.

In order to support the load articles as they are discharged laterally from the platform a front stop mechanism 80 is provided. The front stop mechanism 81 comprises a double acting pneumatic cylinder 83 which is supported by the main frame of the load accumulator (not shown) and has a ram 85 mounted to be reciprocally driven thereby. An end plate 86 is mounted on the ram 85 and has a pair of spacer members 88 extending forwardly therefrom which serve to support a post 90 in an upright configuration. The post 90 extends upwardly into the transfer channel 26 of the spool 16 and has front stop arms 92 and 94 mounted at the upper end thereof which extend laterally within the transfer channel 26 into cross proximity with the inner edges of the blades 28 of the wheel sections 22 of the spool 16. The post 90 is proportioned to fit within the central slot 40 of the load arresting extension 38 of the load accumulating platform 12 in a free fitting sliding relationship. When the ram 85 is in its retracted position shown in FIG. 3 of the drawings the front stop arms 92 and 94 are spaced from the load accumulating platform. When the cylinder 83 is activated to move the ram 85 to the extended position the front stop arms 92 and 94 will move radially outwardly with respect to the spool so as to assume a position in which they will serve to support the upper and lower edges of the last load item of the stack of load items in a substantially vertical plane which is a tangent to the periphery of the circular wheel sections 22. The front stop arms 92 and 94 serve to cooperate with the back stop to maintain the accumulated load in a side-by-side stacked relationship during the lateral transfer of the load into the recepticals 70.

The recepticals 70 serve to carry the accumulated load into an end loading station of a carton loading machine.

The load items 100 which as previously indicated may be in the form of soft resilient flexible pouches or pads such as sanitary napkins are delivered one at a time by means of an impeed conveyor generally identified by the reference numeral 102 (FIG. 1). The load items 100 are initially driven along a first guide path 104 and are selectively directed to continue along the guide path 104 or along a branch path 106. A branch path 106 extends to each load accumulating station with the exception of the final load accumulating station at which the primary path 104 terminates.

As shown in FIGS. 1 and 2 of the drawings, the primary conveyor 108 comprises a series of conveyor belts 112, 114, 116 and 118 which form a continuous upper support for the first guide path 104. The conveyor belts 110 are mounted on rollers 120 and 122. The conveyor belt 112 is mounted on the roller 122 and a further roller 124. The conveyor belts 114 are mounted on the roller 124 and a further roller 126 (FIG. 2). The conveyor belt 116 is mounted on rollers 126 and 128 and further and subsequent conveyors 118 are similarly serially connected.

The forward run portions of the conveyors belts 110, 112, 114, 116 and 118 form an upper wall of the primary load transporting path 104.

A secondary conveyor 130 is formed from a pair of endless conveyor belts 132 which have a forward run which includes a push portion 134, a second push 136 and a third portion 138. Support portions 140 and 142 support opposite ends of the conveyors 132 and 134. Tensioning rollers 144 serve to maintain tension in the return run of the conveyor belt 132 and 134.

The first portion 134 of the forward run of the conveyor belts 132 extends in a face to face relationship with the forward run of the conveyors belts 110 to form a load transporting nip 146 therebetween. The first portion 134 extends to the first load switching station 150. The second portion 136 of the forward run of the conveyor belts extends along a curved path in which it is supported on a backing plate 148. The third portion 138 is downwardly and forwardly inclined to the roller 142.

A further conveyor belt 152 is mounted on the roller 142 and one end then has its other end mounted on a roller 154. The roller 154 is supported on an arm 156 which is mounted on the frame 80 by means of support posts 158. The roller 154 is located in the transfer channel 26 of the load accumulating spool 16.

The secondary conveyor also includes a third conveyor belt 160 which has one end mounted on a shaft 162 located in the transfer station and its other end mounted on a roller 164. A fourth conveyor belt 166 has one end mounted on the roller 164 and its other end mounted on a roller 168. The conveyors 160 and 166 have their forward runs located on one side of the branch path 106 as do the conveyor belts 132 and 133.

A fourth conveyor belt 170 has one end extending around the shaft 162 and its other end extending around a roller 172. The forward run portion 174 of the belt extends in a face-to-face relationship with the portion of the forward run of the conveyor belt 110 which extends downstream from the load switching station 150. A series of small air nozzles 176 are also arranged in a side-by-side relationship between the shaft 162 and the roller 172 and serve to provide an air cushion support for the load items as they are carried away from the load switching station.

A fifth conveyor belt 174 extends between the rollers 172 and 173 so that its forward run extends in a face-to-face relationship with the forward run of the conveyor belt 112.

Figure 6:
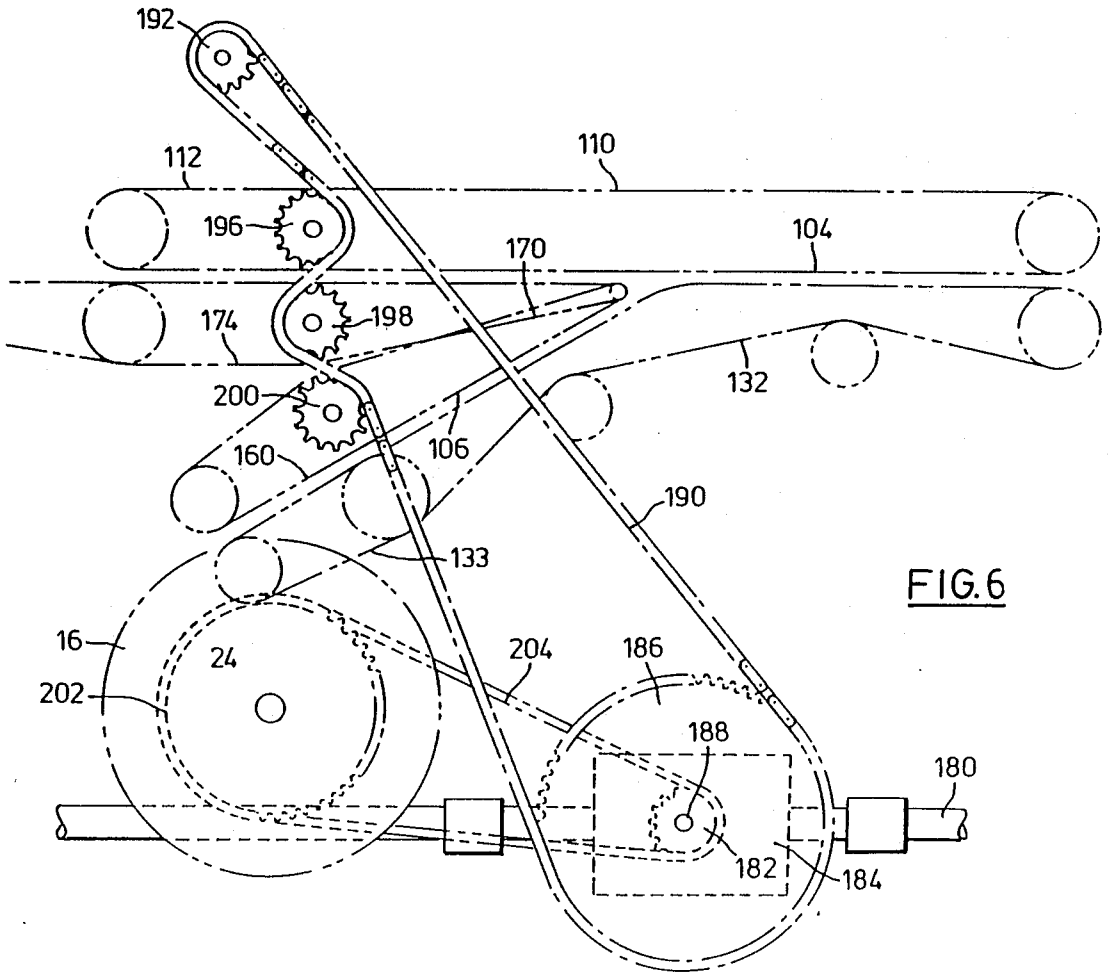
FIG. 6 is a side view illustrating the power transmission system for the various conveyors and load accumulator in one load accumulating station.

The power transmission system used to power the conveyor 110, 132, 160, 170, 174 and 112 is illustrated in FIG. 6 of the drawings. As shown in FIG. 6 of the drawings a drive shaft 180 which is rotatably driven from a primary power source is connected to a sprocket 182 through a gear box 184. A sprocket 186 is also mounted on the power output shaft 188 of the gear box 184. A drive chain 190 has one end mounted on the sprocket 186 and it extends around a sprocket 192 which is mounted on a support post 194 (FIG. 2) carried by the frame. The chain 190 also drivingly engages the sprockets 196, 198 and 200 which are mounted on the rollers 122, 172 and 164 respectively so as to rotatably drive the conveyor belt 110, 112 170, 174 and 160. The spool 16 is drivingly connected to the sprocket 202 through the shaft 24. The drive chain 204 connects the sprocket 202 to the sprocket 182 so that the spool 16 is rotatably driven through the gear box 184.

The conveyor belts 132 and 133 are powered by a suitable drive train (not shown) so that they travel at the same speed as the conveyor 110. These conveyor belts are free running belts which will be driven by the perret belts through the load items as the load items are driven along the guide paths 104 and 106.

For the purposes of selectively directing load items so that they will move along the primary guide path or along the branch guide path when passing through the load switching stations a plurality of nozzles 206 are located in one side of the switching station and a plurality of nozzles 208 are located on the other side of the switching station. The nozzles 206 are arranged to discharge a jet of air downwardly toward the load items to deflect the load items downwardly out of the primary load transporting path 104 into the nip formed between the conveyor belts 106 and 132 for movement along the branch path 106. The nozzles 208 are arranged to direct a jet of air upwardly so as to support the load items 100 in the primary load supporting path 104 as they are driven through the switching station 150.

A counting device 210, 211 is provided in the guide path 104 immediately in advance of the branch path 106 to count the number of load items which are directed along the branch path 106. This counting device 210 may be used to control the on/off operation of the nozzles 206 and 208 so that the nozzle 206 will be deactivated and the nozzles 208 activated when a predetermined number of load items are directed along the branch path 106. A verification counting device 213 is provided in the branch path 106 which serves to verify that the required number of items have been directed along the branch path 106.

METHOD OF OPERATION

Figure 3:
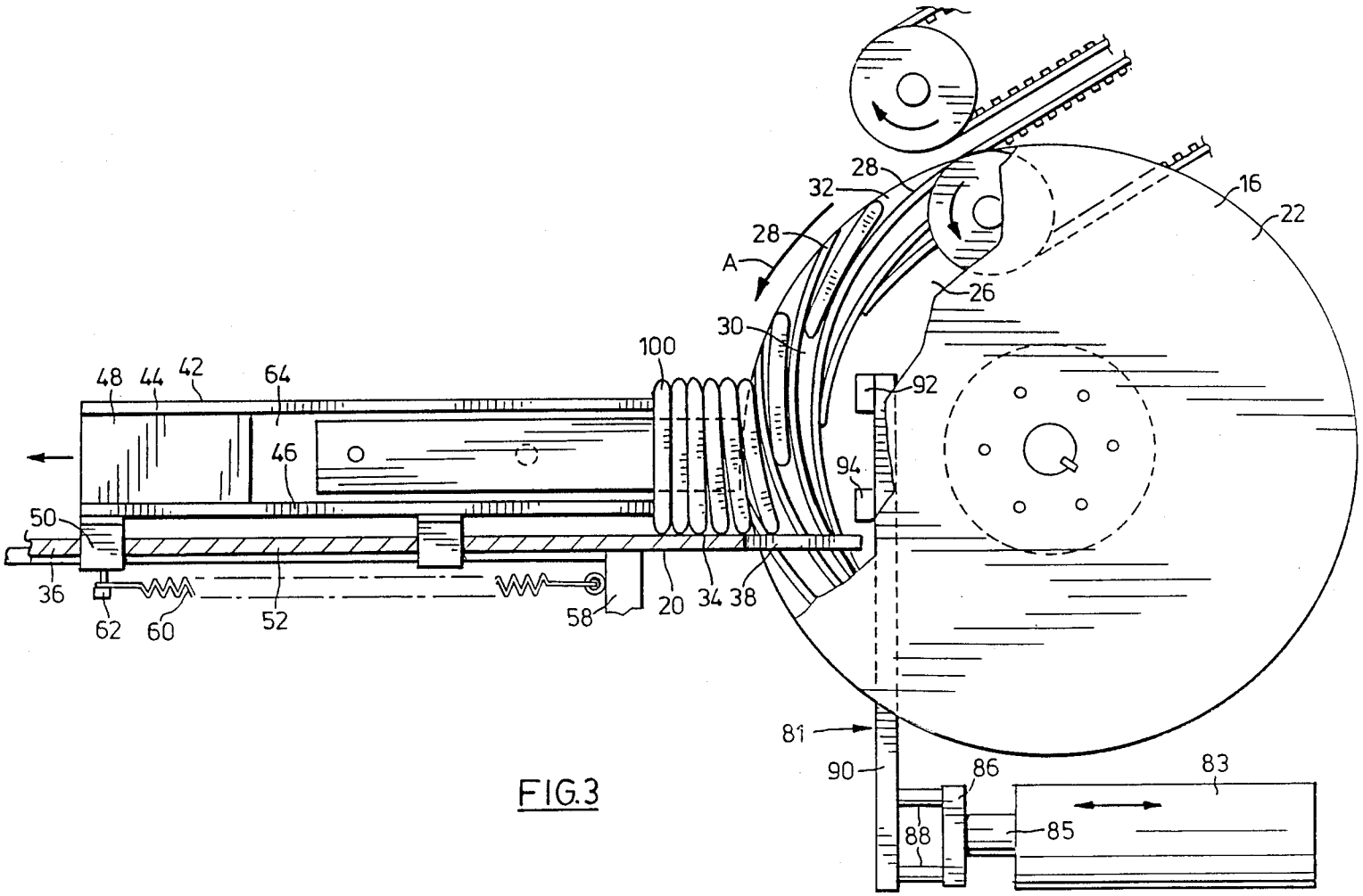
FIG. 3 is an enlarged partially sectioned side view of a load accumulating spool and platform illustrating the manner in which load actives are accumulated on the platform.

Load items are removed one at a time from the infeed conveyor 102 into the first guide path 104 and are transmitted to the first switching station. A predetermined number of load items is redirected at the first switching station so as to be driven along the first branch path 106 into the pockets of the spool 16. The individual load items are removed one at a time from successive pockets as shown in FIG. 3 of the drawings and are accumulated on the platform 20. As the load items accumulate on the platform 20 the back stop 42 is moved away from the spool. It will be noted that successive blades 28 of the spool will serve to push each successive load item radially outwardly from its pocket in response to rotation of the spool in the direction of the arrow 16. It will also be noted that each load item is initially spaced from its next following load item at the time when it makes contact with the extension 38 so that no relative sliding movement occurs between the load items as they are accumulated and consequently the items can be arranged in an orderly face-to-face aligned relationship without difficulty.

Once a predetermined number of load items have been deflected through the branch path 106, the air supply to the nozzles 206 is interrupted and air is supplied to the nozzles 208 so that the load items will then continue along the primary path to the next load accumulating station wherein a further predetermined number of load items will be directed along the branch line 106.

When a predetermined number of load items 100 have been accumulated on the platform 20 as previously described, the pneumatic cylinder 83 of the front stop 81 will be activated in order to move with the front stop arms 92, 94 forwardly into engagement with the last load item of the stack of load items which have been discharged onto the platform. The front stop arms 92, 94 will serve to space the last load item from the spool. The pneumatic cylinder 76 will then be activated to cause the pusher blade 68 to advance to push the load items laterally in a direction of the arrow B (FIG. 1) into the receptacle 70. The load items will then be transported by the conveyor 72 into the carton loading station of the carton loading machine.

It will be understood that the conveyor 72 is intermittently advanced so that an empty receptacle 70 will be aligned with each load accumulating platform. If, for example, three load accumulating stations are provided every third receiptical 70 will be aligned with the first load accumulating station.

From the foregoing it will be apparent that the mechanism of the present invention is capable of operating at high speed and it is simple and inexpensive to construct and maintain.

Various modifications of the present invention will be apparent to those skilled in the art.

What is claimed is:

1. In a carton loading machine, a load accumulator for accumulating a load which consists of a plurality of items and transferring the accumulated load into a receptacle comprising;

(a) a load accumulator spool mounted for rotation about a first axis, said spool having a plurality of pockets formed therein at circumferentially spaced intervals about its perimeter, said pockets each having an entrance opening at the perimeter of the spool and extending inwardly from the entrance along a generally spiral path and having an inner end which is radially spaced from said first axis, (b) a transfer channel extending circumferentially of the spool from its perimeter to a radial depth which is greater than that of the inner end of each pocket, (c) load delivery means for delivering load items one at a time to said spool to load each pocket as the spool is rotatably driven, (d) a load accumulating platform having a front end and a back end, said platform having a load arresting extension which is located circumferentially downstream of said load delivery means with respect to the perimeter of the spool, said load arresting extension extending into said transfer channel to a depth which is greater than that of the inner ends of the pockets whereby the movement of the load articles carried by the spool is arrested by the load arresting extension and the load items are discharged onto said platform in a side-by-side relationship, (e) backstop means slidably mounted on said platform for movement toward and away from said spool, said backstop means being normally urged toward said spool and serving to maintain the load items in a side-by-side relationship when they are removed from the spool by the load arresting extension, (f) front stop means arranged opposite the backstop means and mounted for movement between a retracted position in which it is located within said transfer channel inwardly of said inner end of said pockets and an advanced position in which it overlies said platform and is located outwardly from the perimeter of said spool to cooperate with the backstop to form lateral guideways for guiding the lateral transfer of the accumulated load from the platform into a receptacle, (g) pusher means at one side of said platform for pushing the accumulated load along the lateral guideways into a receptacle located at the other side of the platform.

* * * * *